United States Patent [19]

Wyoral

[11] 4,352,337

[45] Oct. 5, 1982

[54] MAST AND BOOM CARRIER COMBINATION FOR SAILING VESSELS

[76] Inventor: Frank J. Wyoral, 7315 Lahser, Birmingham, Mich. 48010

[21] Appl. No.: 145,840

[22] Filed: May 1, 1980

[51] Int. Cl.[3] ..... B63B 17/00

[52] U.S. Cl. ..... 114/343; 114/90; 114/97; 114/364; 211/60 R; 224/42.45 R; 224/273; 224/325; 403/3

[58] Field of Search ..... 211/60 R; 9/1.1, 1.2, 9/1.7; 114/39, 89, 90, 91, 97, 221 R; 280/414 A, 414 R; 224/273, 325, 42.45 R; 403/3; 440/106, 107

[56] References Cited

U.S. PATENT DOCUMENTS

| | | | |
|---|---|---|---|
| 3,054,372 | 9/1962 | Jones | 114/39 |
| 3,118,156 | 1/1964 | Lindquist | 440/109 |
| 3,827,386 | 8/1974 | Faden | 114/91 |
| 3,857,128 | 12/1974 | Gilster | 9/1.2 |
| 4,109,796 | 8/1978 | Mitchell | 211/60 R |

*Primary Examiner*—Sherman D. Basinger
*Attorney, Agent, or Firm*—Harness, Dickey & Pierce

[57] ABSTRACT

This mast and boom carrier combination consists primarily of a bow member and a stern member, having a multiple number of openings, for receiving different sizes of masts and booms, and it is designed for wheeled carrier use in transporting a sailing vessel.

5 Claims, 6 Drawing Figures

MAST AND BOOM CARRIER COMBINATION FOR SAILING VESSELS

BACKGROUND OF THE INVENTION

This invention relates to accessories for sailing vessels, and more particularly, to a mast and boom carrier combination, for sailing vessels.

It is, therefore, the principal object of this invention to provide a mast and boom carrier combination, for sailing vessels, which will be an accessory for a wheeled carrier.

Another object of this invention is to provide a mast and boom carrier combination, for sailing vessels, which will be a unique and improved combination in that it may be readily and easily attached and detached from a sailing vessel, and the combination will include a mounting post pin, that will fasten a prior patented wheeled carrier to the sailing vessel, by inserting a mounting mast-carrier pin through aligned bores of the bracket assembly of the sailing vessel.

Another object of this invention is to provide a mast and boom carrier combination, for sailing vessels, which will be of such structure, that it will be adapted to fit the various sizes of masts and booms, and it will easily attach to the commercially available sailboats, such as the "Sunfish", "Sailfish", "Phantom", "Laser" and similar vessels.

A further object of this invention is to provide a mast and boom carrier combination, for sailing vessels, which will have one component easily and simply attached to a sailing vessel rudder assembly, without the provision of additional components or modifications of the sailing vessel.

A still further object of the invention is to provide a mast and boom carrier combination, for sailing vessels, which will have a longer pin for the bow component, so as to elevate it in height, in order that the mast and boom will clear the towing vehicle, should a trailer be used.

Other objects are to provide a mast and boom carrier combination for sailing vessels, which is simple in design, inexpensive to manufacture, rugged in construction, easy to use, and efficient in operation.

These, and other objects, will be readily evident, upon a study of the following specification and the accompanying drawing.

DESCRIPTION OF THE INVENTION

Figure 1:
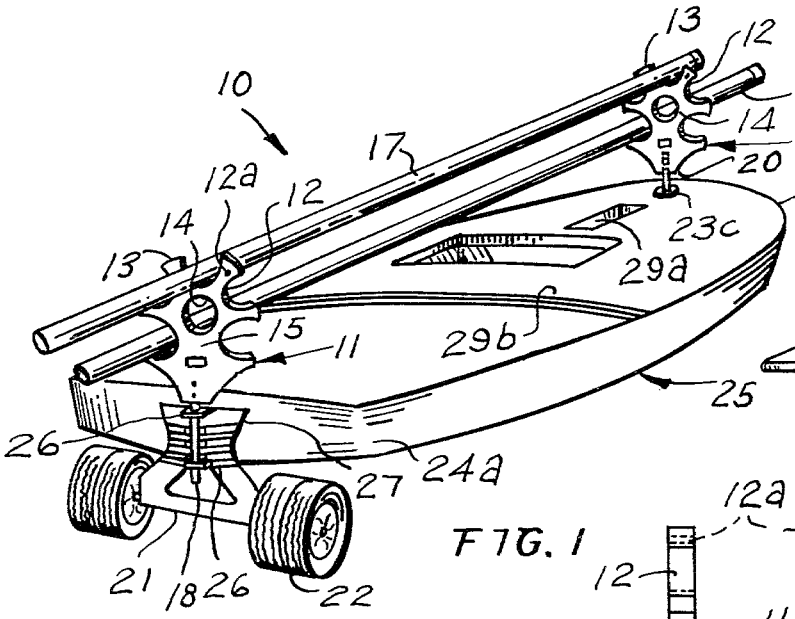
FIG. 1 is a perspective view of the invention, shown in use.

According to this invention, a carrier combination 10 is shown to include a pair of support members 11, having a plurality of various size openings 12 in their outer peripheral side edges 13. Each member 11 includes an opening 14, through its body 15, the openings 12 and 14 serving as a means for placement of mast 16 and boom 17. A pin 18 is fixedly secured, in a suitable manner, within opening 19 through the bottom ends 20 of support members 11, and pin 18 is removably received in either boat carrier 21, having wheels 22, or in holder 23 in the bow 24 of sailing vessel 25.

It shall be noted, that openings **12*a* and 12*b*, through body 15 of the pair of support members 11, provide a means of receiving suitable line, for securing mast 16 and boom 17** thereto.

Holder 23 is hollow, and cylindrical in shape, and is provided with central openings **23*a*, for receiving the pin 18 of a support member 11, and, by removing, so by cutting away, the larger rings 23*b* at the bottom, holder 23 may be adapted to fit the corresponding diameter of the top ring 23*c*, seated into the mast opening 23*d*. In the bow 24 of sailing vessel 25, pin 18, of a support member 11, is inserted in the aligned openings (not shown) of lugs 26 of mounting bracket 27**.

It shall also be noted, that, by providing a longer pin for the support member 11 in the bow 24, the mast 16 and boom 17 may be elevated, so as to clear the towing vehicle, should a trailer be used.

Figure 5:
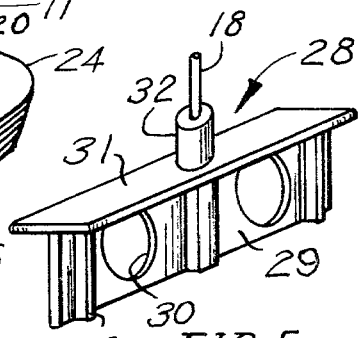
FIG. 5 is an enlarged perspective view of the centerboard mast and boom support mount, shown removed from FIG. 2, and illustrates the pin portion fragmentary.
Figure 2:
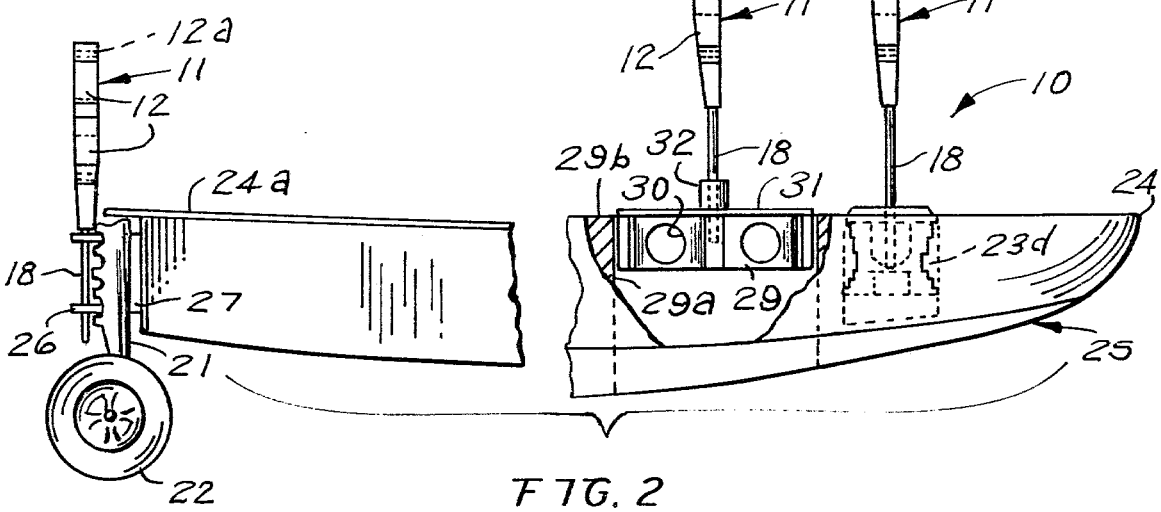
FIG. 2 is an enlarged fragmentary side view of FIG. 1, shown in elevation and partly broken away, and illustrates a centerboard mast and boom support mount, with the mast and boom shown removed therefrom.
Figure 3:
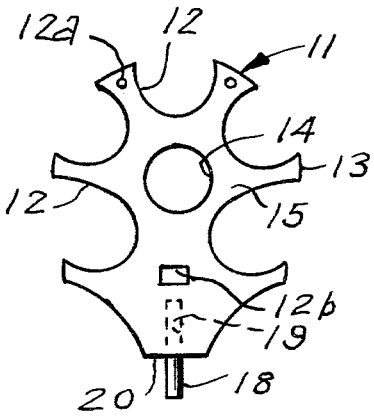
FIG. 3 is an enlarged front elevational view of one of the mast and boom components, shown removed from FIG. 2.
Figure 6:
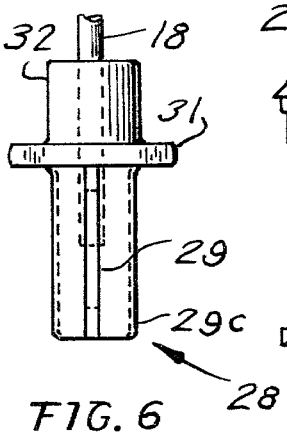
FIG. 6 is a further enlarged side elevation of FIG. 5.
Figure 4:
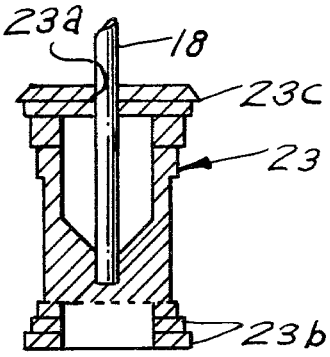
FIG. 4 is an enlarged cross-sectional view of a cylindrical holder, shown in elevation, with the pin portion of one of the mast and boom components illustrated fragmentary.

Referring now to FIGS. 5 and 6, a modified support mount 28, for receiving a pin 18 of a support member 11, is shown to include a rectangular body 29, which is removably received in opening **29*a* of the cowl 29*b*. Body 29 further includes integral side ribs 29*c*, which increases the strength of body 29. At the top of body 29 is a horizontally disposed upper wall 31. Upper wall 31 extends laterally outwardly beyond body 29 to limit downward movement of body 29 into cowl 29*b*. Pin receiving member 32 is located on upper body 31**.

While various changes may be made in the detail construction, it is understood that such changes will be within the spirit and scope of the present invention, as is defined by the appended claims.

What I now claim is:

1. A mast and boom carrier for sailing vessels, comprising a pair of support members for removably supporting masts and booms, each of said support members having a body with a plurality of outwardly facing openings in a side peripheral edge thereof for receiving mast and boom portions; first means for removably attaching one of said pair of support members to a stern of a vessel; and second means for removably attaching the other of said pair of support members to a relatively forward portion of a vessel, each of said first and second means for attaching said pair of support members including a pin secured to each said body, said second means including a cylindrical holder receiving said pin and having a plurality of radially outwardly extending portions on the bottom end thereof, said radially outwardly extending portions extending radially outwardly different distances so as to enable said cylindrical holder to be accommodated in various diameters of mast openings in a sailing vessel.

2. A mast and boom carrier for sailing vessels, comprising a pair of support members for removably supporting masts and booms, each of said support members having a body with a plurality of outwardly facing openings in a side peripheral edge thereof for receiving mast and boom portions; first means for removably attaching one of said pair of support members to a stern of a vessel; and second means for removably attaching the other of said pair of support members to a relatively forward portion of a vessel, each of said first and second means for attaching said pair of support members including a pin secured to each said body, said second means including a support mount having a rectangular body receiving said pin and adapted to be received in a cowl opening of a boat, said rectangular body having a horizontally disposed upper wall, a vertical wall extending horizontally downwardly from said upper wall and a vertical hole for receiving said pin, said upper wall extending laterally outwardly beyond said vertical wall to limit downward movement of said body into said cowl opening, and said vertical wall having a plurality of structurally strengthening side ribs and being adapted to extend downwardly into said cowl opening.

3. The carrier according to claim 1 or 2 wherein each said body has a plurality of holes extending therethrough for receiving lines for securing a mast and boom thereon.

4. The carrier according to claim 1 or 2, wherein said plurality of openings comprise a plurality of openings of different sizes.

5. The carrier according to claim 1 or 2, wherein each said body has a plurality of holes extending therethrough for receiving lines for securing a mast and boom thereon and wherein said plurality of openings comprise a plurality of openings of different sizes.

* * * * *